US009288561B1

(12) United States Patent
Chu

(10) Patent No.: US 9,288,561 B1
(45) Date of Patent: Mar. 15, 2016

(54) SPEAKER DEVICE

(71) Applicant: FORTUNE GRAND TECHNOLOGY INC., Taoyuan (TW)

(72) Inventor: Walter Ka Wai Chu, Taoyuan (TW)

(73) Assignee: FORTUNE GRAND TECHNOLOGY INC., Taoyuan County (TW)

( * ) Notice: Subject to any disclaimer, the term of this patent is extended or adjusted under 35 U.S.C. 154(b) by 0 days.

(21) Appl. No.: 14/726,194

(22) Filed: May 29, 2015

(30) Foreign Application Priority Data

Apr. 20, 2015 (TW) ..... 104112523 A

(51) Int. Cl.
*H04R 1/28* (2006.01)
*H04R 1/02* (2006.01)

(52) U.S. Cl.
CPC ..... *H04R 1/02* (2013.01)

(58) Field of Classification Search
CPC . H04R 1/283; H04R 1/2834; H04R 2201/025
USPC ..... 181/148, 151, 199; 381/353, 354, 387, 381/395
See application file for complete search history.

(56) References Cited

U.S. PATENT DOCUMENTS 4,889,208 A * 12/1989 Sugihara ..... H04R 1/288 181/141
5,450,495 A * 9/1995 Goldfarb ..... H04R 5/02 181/196
5,664,020 A * 9/1997 Goldfarb ..... H04R 5/02 181/196
6,292,573 B1 * 9/2001 Zurek ..... H04R 1/2811 379/428.01
7,116,795 B2 * 10/2006 Tuason ..... H04R 1/021 381/338
2006/0272885 A1 * 12/2006 Lee ..... H04R 1/2803 181/199
2007/0064970 A1 * 3/2007 Yang ..... H04R 1/2803 381/388
2007/0215407 A1 * 9/2007 Chiang ..... H04R 1/2873 181/156
2008/0279406 A1 * 11/2008 D'Hoogh ..... H04R 1/2811 381/332
2009/0052723 A1 * 2/2009 Lin ..... H04R 1/2811 381/391
2009/0175483 A1 * 7/2009 Huang ..... H04R 1/026 381/386
2014/0348349 A1 * 11/2014 Nagaoka ..... H04R 1/288 381/162

FOREIGN PATENT DOCUMENTS

JP 02195797 A * 8/1990

* cited by examiner

*Primary Examiner* — Jeremy Luks
(74) *Attorney, Agent, or Firm* — WPAT, P.C.; Anthony King

(57) ABSTRACT

A speaker device includes a main cabinet composed of a cabinet body and a speaker mounted on the cabinet body; an extendable cabinet composed of a bellows tube and a passive diaphragm, the bellows tube having a front end communicably connected to the cabinet body and a rear end closed by the passive diaphragm, and the passive diaphragm being axially aligned with the speaker; and a damping assembly being arranged in the cabinet body and in the bellows tube, and having a front end connected to the cabinet body and a rear end to the passive diaphragm. With these arrangements, the speaker device can have improved bass performance in the entire low-frequency band instead of being limited to only a few low-frequency points.

6 Claims, 2 Drawing Sheets

SPEAKER DEVICE

CROSS-REFERENCE TO RELATED APPLICATION

This non-provisional application claims priority under 35 U.S.C. §119(a) on Patent Application No(s). 104112523 filed in Taiwan, R.O.C. on Apr. 20, 2015, the entire contents of which are hereby incorporated by reference.

FIELD OF THE INVENTION

The present invention relates to a speaker device, and more particularly to a speaker device that has improved bass performance in the entire low-frequency band instead of being limited to only a few low-frequency points.

BACKGROUND OF THE INVENTION

Currently, various kinds of portable electronic devices are very popular among consumers, resulting in the demand for portable speaker devices. The portable speaker device is small in volume, and so are the speaker and cabinet thereof. The small cabinet tends to produce higher resonance frequency and thereby has weak bass performance. Conventionally, a passive speaker having only a diaphragm and a spider without a magnet is mounted on the small cabinet to improve the bass performance thereof. When the speaker of a portable speaker device vibrates, air inside the cabinet is vibrated, bringing the passive speaker to vibrate at the same time and thereby improve the bass performance of the portable speaker device. However, the improvement of the bass performance brought by the passive speaker is very limited. It is therefore desirable to develop a speaker device that has improved bass performance in the entire low-frequency band instead of being limited to only a few low-frequency points.

SUMMARY OF THE INVENTION

A primary object of the present invention is to develop a speaker device that has improved bass performance in the entire low-frequency band instead of being limited to only a few low-frequency points.

To achieve the above and other objects, the speaker device provided according to the present invention includes a main cabinet composed of a cabinet body and a speaker mounted on the cabinet body; an extendable cabinet composed of a bellows tube and a passive diaphragm, the bellows tube having a front end communicably connected to the cabinet body and a rear end closed by the passive diaphragm, and the passive diaphragm being axially aligned with the speaker; and a damping assembly being arranged in the cabinet body and in the bellows tube, and having a front end connected to the cabinet body and a rear end to the passive diaphragm.

In an embodiment of the speaker device according to the present invention, the bellows tube has at least one reinforcing rib provided on an outer surface thereof.

In an embodiment of the speaker device according to the present invention, the passive diaphragm has a weighting member mounted thereon.

In an embodiment of the speaker device according to the present invention, the damping assembly includes a holding unit, at least one elastic unit and a connecting unit. The holding unit is connected to the cabinet body, the elastic unit is disposed in the holding unit, and the connecting unit is connected to between the elastic unit and the passive diaphragm.

In an embodiment of the speaker device according to the present invention, the holding unit includes at least one tubular holding member connected at a front end to around a rear end of the speaker; the elastic unit includes an outer ring portion held in the tubular holding member, an inner ring portion, and a plurality of elastic ribs connecting and locating the inner ring portion to a center of the outer ring portion; and the connecting unit is in the form of a connecting rod having an end connected to the inner ring portion of the elastic unit and another end connected to the passive diaphragm.

In an embodiment of the speaker device according to the present invention, the connecting rod is a hollow rod.

With these arrangements, the speaker device of the present invention can have improved bass performance in the entire low-frequency band instead of being limited to only a few low-frequency points.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
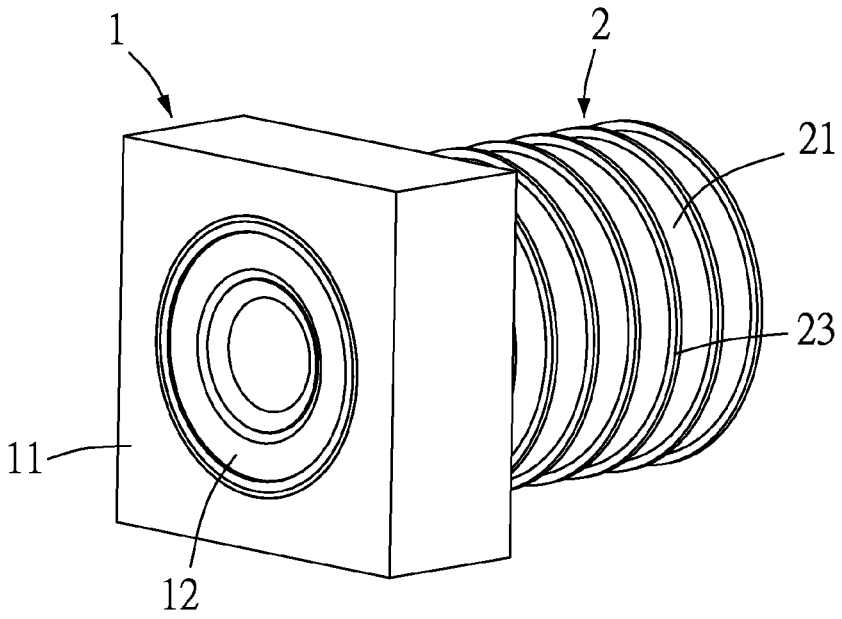
FIG. 1 is a front perspective view of a speaker device according to a preferred embodiment of the present invention.
Figure 2:
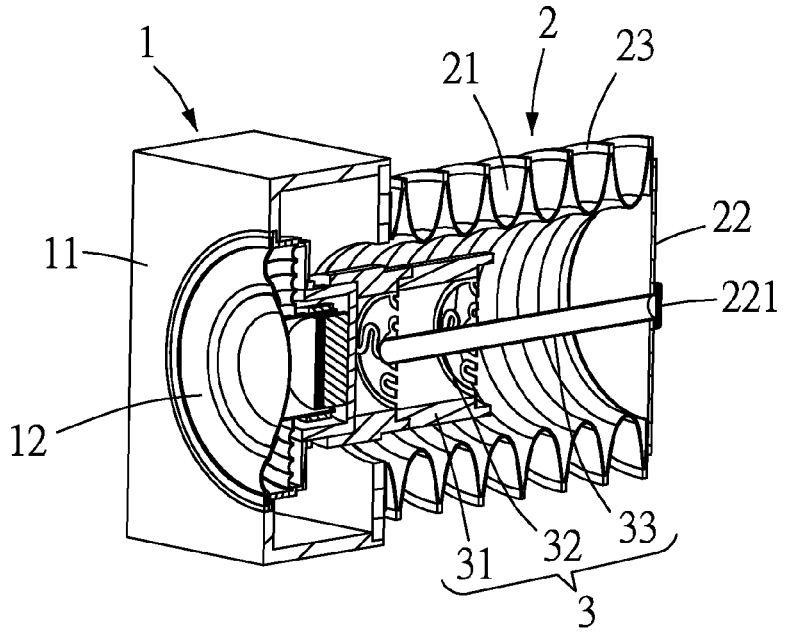
FIG. 2 is a cutaway view of the speaker device of FIG. 1, viewed from a front end thereof.
Figure 3:
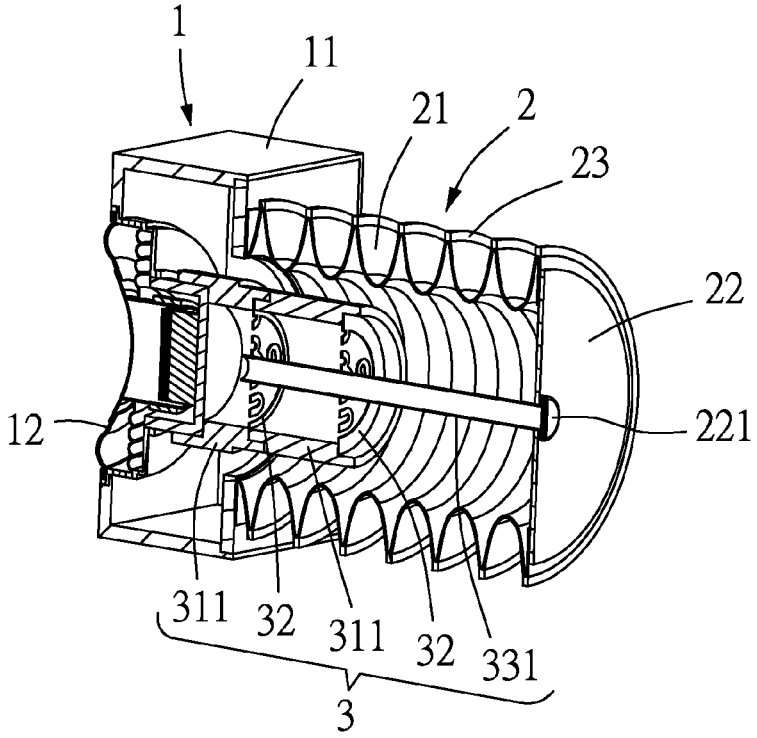
FIG. 3 is another cutaway view of the speaker device of FIG. 1, viewed from a rear end thereof.

Please refer to FIGS. 1, 2 and 3, in which a speaker device according to a preferred embodiment of the present invention is illustrated. As shown, the speaker device includes a main cabinet 1, an extendable cabinet 2 and a damping assembly 3. The main cabinet 1 includes a cabinet body 11 and a speaker 12. The cabinet body 11 can be made of a metal material, a fiberglass reinforced plastic material, or a wooden material; and can be a rectangular cuboid or a square cuboid in shape. The speaker 12 is connected to one face of the cabinet body 11 by means of gluing, press-fitting or screwing, such that a diaphragm and a surround of the speaker 12 are exposed from the face of the cabinet body 11. The extendable cabinet 2 includes a bellows tube 21 and a passive diaphragm 22. The bellows tube 21 is made of a polyvinylchloride (PVC) material having a predetermined low rigidity and is in the form of an axially extendable and compressible cylindrical tube. The passive diaphragm 22 is in the form of a round disk without a surround, and is connected to a rear end of the bellows tube 21 by means of gluing or press-fitting to seal the rear end of the bellows tube 21. Meanwhile, a front end of the bellows tube 21 is connected to the cabinet body 11 by means of gluing, press-fitting or screwing, allowing the bellows tube 21 to communicate with the cabinet body 11. The passive diaphragm 22 has a center aligned with a center of the speaker 12 and is located on a centerline of the bellows tube 21. The damping assembly 3 is located in the cabinet body 11 and in the bellows tube 21 with a front end glued, press-fitted or screwed to the main cabinet 1 and a rear end to the center of the passive diaphragm 22. With the damping assembly 3 being located in the cabinet body 11 and the bellows tube 21, the bellows tube 21 can be extended or compressed by a predetermined small range when the speaker's diaphragm vibrates. That is, the bellows tube 21 can not be completely extended or compressed.

As having been mentioned above, when the speaker 12 vibrates, the bellows tube 21 will be slightly extended or compressed. More specifically, when the speaker vibrates inwards, air inside the cabinet body 11 and the bellows tube 21 will bring the bellows tube 21 to axially expand by a predetermined extent; and, when the speaker vibrates outwards, air inside the cabinet body 11 and the bellows tube 21 will bring the bellows tube 21 to axially contract by a predetermined extent. Therefore, the provision of the bellows tube 21, the passive diaphragm 22 and the damping assembly 3 enables the speaker device of the present invention to have improved bass performance in the entire low-frequency band instead of being limited to only a few low-frequency points. More specifically, in the present invention, the extendable cabinet 2 has replaced the surround of a conventional passive speaker, and the damping assembly 3 is further provided to enhance the performance of the speaker device.

As can be seen in FIGS. 1 to 3, in the speaker device of the present invention, the bellows tube 21 has at least one reinforcing rib 23 provided on an outer surface thereof by means of gluing or press-fitting. The reinforcing ribs 23 can be formed of a PVC material having a predetermined high rigidity. In the case the bellows tube 21 has a helical structure, only one reinforcing rib 23 is needed to extend helically along the outer surface of the bellows tube 21. In the case the bellows tube 21 includes a plurality of annular bodies connected to one another via pleated joints, then a plurality of annular reinforcing ribs 23 can be provided to respectively circumferentially extend along the outer surface of the bellows tube 21. The provision of the reinforcing ribs 23 prevents the bellows tube 21 from becoming deformed or collapsed under an extremely large air pressure difference occurred when the speaker device vibrates in a push-pull motion at a high speed. Any deformation or collapse of the bellows tube 21 caused by the large air pressure difference will result in distortion of sound and accordingly, degraded sound quality and volume. Therefore, the bellows tube 21 with the reinforcing ribs 23 provided thereon gives the whole extendable cabinet 2 a strengthened structure to resist the high-speed and strong air pressure produced by the speaker 12 in an actuated state, enabling the bellows tube 21 to fully function for the speaker to work smoothly. The bellows tube 21 with the reinforcing ribs 23 also produces good damping effect on the passive diaphragm 22, enabling the passive diaphragm 22 to maintain axially forward and backward vibration in a horizontal direction. The bellows tube 21 with the reinforcing ribs 23 also provides sufficient elastic restoring force for the passive diaphragm 22 to return to its home position in the speaker device. In other words, the bellows tube 21 with the reinforcing ribs 23 has important influence on the smooth operation of the whole speaker device.

Please refer to FIGS. 2 and 3. The passive diaphragm 22 may have a weighting member 221 connected thereto by means of gluing, press-fitting or screwing, so as to have increased weight and thereby produce enhanced low-frequency sound. The weighting member 221 may be disposed on an outer side or an inner side of the passive diaphragm 22, such that the increased weight produced by the weighting member 221 can be evenly distributed over the whole passive diaphragm 22. The weighting member 221 can be disposed on a center of the passive diaphragm 22. Alternatively, more than one weighting member 221 can be provided in pairs and symmetrically disposed on the passive diaphragm 22 relative to the center thereof.

As shown in FIGS. 1 to 3, in the speaker device of the present invention, the damping assembly 3 includes a holding unit 31, at least one elastic unit 32 and a connecting unit 33. The holding unit 31 is connected to the main cabinet 1 by means of gluing, press-fitting or screwing; the elastic unit 32 is connected to the holding unit 31 by gluing, press-fitting or screwing; and the connecting unit 33 is connected to the elastic unit 32 and the passive diaphragm 22 by gluing, press-fitting or screwing. With the damping assembly 3, it is also able to prevent the extendable cabinet 2 from shifting downward due to the force of gravity.

Please refer to FIGS. 1 to 4. In the speaker device of the present invention, the holding unit 31 may include at least one tubular holding member 311, which looks like an annular ring and has a front end fixedly mounted around a rear end of the speaker 12 by gluing, press-fitting or screwing. The elastic unit 32 includes an outer ring portion 321, an inner ring portion 322 and a plurality of elastic ribs 323. The outer and inner ring portions 321, 322 are both in the form of an annular ring. In an embodiment of the present invention, by way of gluing, press-fitting or screwing, the outer ring portion 321 is held in an annular groove formed around a rear end of the tubular holding member 311. In another embodiment, the outer ring portion 321 is first disposed in an annular groove formed around a rear end of a first tubular holding member 311 and then held therein by engaging an axially forward protruded annular flange, formed on a front end of a second tubular holding member 311, with the aforesaid annular groove. The elastic ribs 323 are connect to between the outer and the inner ring portion 321, 322, such that the inner ring portion 322 is located at a center of the outer ring portion 321. Further, the elastic ribs 323 are radially equally spaced from one another between the outer and the inner ring portion 321, 322. In an embodiment of the present invention, the connecting unit 33 is in the form of a connecting rod 331, which has an end glued to or press-fitted in the inner ring portion 322 and another end connected to the center of the passive diaphragm 22 by way of gluing, press-fitting or screwing. With these arrangements, the elastic unit 32 and the connecting rod 331 together provide a function like that provided by the bellows tube 21 and the reinforcing ribs 23, that is, preventing the actuated passive diaphragm 22 from shifting away from its axially forward and backward motion in a horizontal direction and producing an elastic restoring force for the passive diaphragm 22 to stably vibrate forward and backward in a horizontal direction. Therefore, the damping assembly 3 also has an important influence on the smooth operation of the passive diaphragm 22. While the elastic unit 32 shown in the illustrated figures is a flat member, it is understood, in practical implementation of the present invention, the elastic unit 32 can be otherwise a piece of corrugated disk without elastic ribs, similar to the spider or damper for a general speaker.

Figure 4:
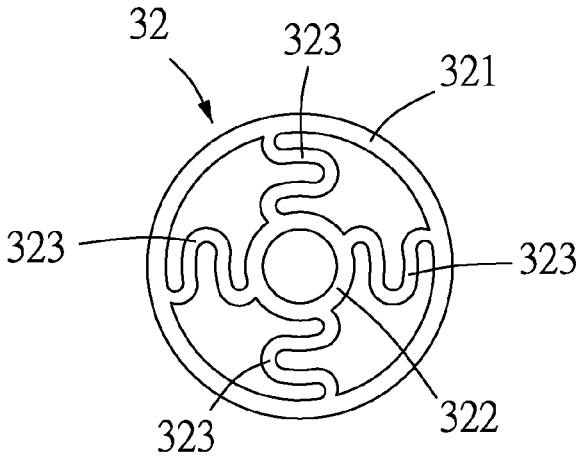
FIG. 4 is a plan view of an elastic unit included in the speaker device according to the preferred embodiment of the present invention.

As can be seen in FIGS. 2, 3 and 4, in the speaker device according to the preferred embodiment of the present invention, the elastic ribs 323 are respectively U-shaped, and the connecting rod 331 can be hollow or solid and is therefore adjustable in its weight according to actual need.

Since the bellows tube 21, the reinforcing ribs 23, the passive diaphragm 22 and the damping assembly 3 all form a part of a vibration system of the speaker device and respectively have a certain weight, these components, when being actuated, would have an influence on the resonance frequency presented by the speaker device. In the preferred embodiment, a total weight of the passive diaphragm 22, including the weighting member 221 thereof, the connecting rod 331 and the elastic unit 32 is heavier than a total weight of the bellows tube 21 and the reinforcing ribs 23. More specifically, the total weight of the bellows tube 21 and the reinforcing ribs 23 should not be 20% lower than a total weight of the passive diaphragm 22, including the weighting member 221 thereof, the connecting rod 331, the elastic unit 32, the bellows tube 21 and the reinforcing ribs 22.

The main cabinet 1 and the extendable cabinet 2 together form a substantially closed cabinet. More specifically, while there are still micro openings formed on the main cabinet 1 and the extendable cabinet 2 to allow proper flowing of air into and out of the cabinets 1, 2, the main and extendable cabinets 1, 2 are generally a closed structure. Therefore, when the speaker 12 is actuated, not all the air in the two cabinets 1, 2 can be forced out of the cabinets 1, 2, allowing the two cabinets 1, 2 to function as an air spring, which has an influence on the smooth operation of the whole speaker device. In other words, in the speaker device of the present invention, there are at least three elastic components that have an influence on the smooth operation of the speaker device, namely, the bellows tube 21, the elastic unit 32 and the above-mentioned air spring. More specifically, the smooth operation of the speaker device is generally determined by an elastic coefficient of the above-mentioned air spring. In other words, the above-mentioned air spring has a greater influence than the bellows tube 21 and the elastic unit 32 on the smooth operation of the speaker device.

Through different combinations of weight and smooth operation between the above-mentioned components of the speaker device, multiple sets of combination of weight and smooth operation are formed to interact with one another, enabling the resonance frequency to be distributed over the entire low-frequency band instead of being concentrated on only a few resonance frequency points. More specifically, with the present invention, the Q value, or the sharpness of resonance frequency, of a speaker device can be changed and reduced, so as to widen the effective range of the bandwidth of the resonance frequency. In contrast, in a conventional speaker device, the increase of the weight of the passive speaker can only make the resonance frequency to concentrate on a few points.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A speaker device, comprising:

a main cabinet including a cabinet body and a speaker mounted on the cabinet body;

an extendable cabinet including a bellows tube and a passive diaphragm; the bellows tube having a front end communicably connected to the cabinet body and a rear end closed by the passive diaphragm, and the passive diaphragm being axially aligned with the speaker; and a damping assembly being arranged in the cabinet body and in the bellows tube, and having a front end connected to the cabinet body and a rear end to the passive diaphragm.

2. The speaker device as claimed in claim 1, wherein the bellows tube has at least one reinforcing rib provided on an outer surface thereof.

3. The speaker device as claimed in claim 1, wherein the passive diaphragm has a weighting member mounted thereon.

4. The speaker device as claimed in claim 1, wherein the damping assembly includes a holding unit, at least one elastic unit and a connecting unit; and the holding unit being connected to the cabinet body, the elastic unit being disposed in the holding unit, and the connecting unit being connected to between the elastic unit and the passive diaphragm.

5. The speaker device as claimed in claim 4, wherein the holding unit includes at least one tubular holding member connected at a front end to around a rear end of the speaker; the elastic unit includes an outer ring portion held in the tubular holding member, an inner ring portion, and a plurality of elastic ribs connecting and locating the inner ring portion to a center of the outer ring portion; and the connecting unit is in the form of a connecting rod having an end connected to the inner ring portion of the elastic unit and another end connected to the passive diaphragm.

6. The speaker device as claimed in claim 5, wherein the connecting rod is a hollow rod.

* * * * *